US006041214A

United States Patent [19]

Fujikura et al.

[11] Patent Number: 6,041,214

[45] Date of Patent: Mar. 21, 2000

[54] IMAGE FORMING APPARATUS CAPABLE OF IMPROVING EASE OF USE IN MAIL BIN MODE

[75] Inventors: Teruhiko Fujikura; Naoyoshi Kinoshita, both of Aichi-Ken; Makoto Fujii, Itami; Kenji Matsuhara; Munehiro Natsume, both of Toyokawa, all of Japan

[73] Assignee: Minolta Co., Ltd., Osaka, Japan

[21] Appl. No.: 09/232,996

[22] Filed: Jan. 19, 1999

[30] Foreign Application Priority Data

Jan. 19, 1998 [JP] Japan ..... 10-007680

[51] Int. Cl.[7] ..... G03G 15/00

[52] U.S. Cl. ..... 399/403; 399/405

[58] Field of Search ..... 399/82, 361, 381, 399/403, 405; 271/279, 287, 292, 293, 298

[56] References Cited

U.S. PATENT DOCUMENTS 4,522,486 6/1985 Clark et al. ..... 399/403
5,328,169 7/1994 Mandel ..... 271/298 X
5,358,238 10/1994 Mandel et al. ..... 271/298
5,551,686 9/1996 Sanchez et al. ..... 271/298
5,742,890 4/1998 Kato et al. ..... 399/403

FOREIGN PATENT DOCUMENTS 0 637 164 A2 2/1995 European Pat. Off. .
7-97125 4/1995 Japan .

*Primary Examiner*—Sandra Brase
*Attorney, Agent, or Firm*—Morrison & Foerster LLP

[57] ABSTRACT

An image forming apparatus is provided with a printer section for printing an image on a sheet and a sorter having a plurality of bin trays. Printed sheets discharged from the above printer section are discharged onto the designated bin tray corresponding to the destination of the print job among the plurality of bin trays. There are provided a page number counting section for counting the number of pages of the print job and a capacity changing section for increasing the capacity of the designated bin tray when the number of pages of the print job is greater than a specified number. This image forming apparatus can improve the ease of use in a mail bin mode.

19 Claims, 8 Drawing Sheets

IMAGE FORMING APPARATUS CAPABLE OF IMPROVING EASE OF USE IN MAIL BIN MODE

This application is based on application No. 10-7680 filed in Japan, the contents of which are hereby incorporated by reference.

BACKGROUND OF THE INVENTION

The present invention relates to image forming apparatuses, and more particularly, to an image forming apparatus that is provided with a sorter having a plurality of bin trays and discharges a printed sheet while sorting the sheet into any of the bin trays.

There has conventionally been a known image forming apparatus having a mail bin mode in which an image is printed on a sheet in a printer section and the printed sheet is discharged while being sorted into a bin tray (designated bin tray) corresponding to the destination of a print job among a plurality of bin trays. In regard to the image forming apparatus of this type, there is a proposed system in which a printed sheet is discharged onto the designated bin tray when the number of pages of the print job is smaller than the capacity of the designated bin tray and a printed sheet is discharged onto another bin tray having a capacity larger than that of the designated bin tray when the number of pages of the print job is greater than the capacity of the designated bin tray (prior art reference of Japanese Patent Laid-Open Publication No. HEI 7-97125).

However, according to the prior art system, it is sometimes the case where the printed sheet of the print job of a specified destination might be discharged onto a bin tray other than the designated bin tray and the user might forget to take the printed sheet discharged onto the other bin tray. It is also required to check all the bin trays in order to avoid leaving the printed sheet behind. As described above, there is the problem that the ease of use in the mail bin mode is not good in the prior art system.

SUMMARY OF THE INVENTION

Accordingly, an object of the present invention is to provide an improved image forming apparatus capable of eliminating the above-mentioned problem.

In order to achieve the above object, there is provided an image forming apparatus comprising:

- a printer section for printing an image on a sheet;
- a sorter having a plurality of bins onto which a sheet printed with the image by the printer section is discharged;
- a receiving section for receiving a print job transmitted externally, the print job including information indicating the number of pages of the image to be printed and the bin onto which the sheet printed with the image is to be discharged; and
- a controller for increasing a sheet accommodating capacity of said bin onto which the sheet is to be discharged when the number of pages of the print job received by said receiving section is greater than a specified number.

According to the above image forming apparatus, the controller increases a sheet accommodating capacity of the bin onto which the sheet is to be discharged when the number of pages of the print job received by the receiving section is greater than a specified number. Therefore, the printed sheet is surely discharged onto the bin corresponding to the bin information of the print job. As a result, the user has only to check the printed sheet merely on the above bin and obviates the need for checking the other bins, and this avoids leaving the printed sheet behind. Therefore, the apparatus can improve the ease of use in the mail bin mode.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Embodiments of the present invention will be described in detail below.

Figure 1:
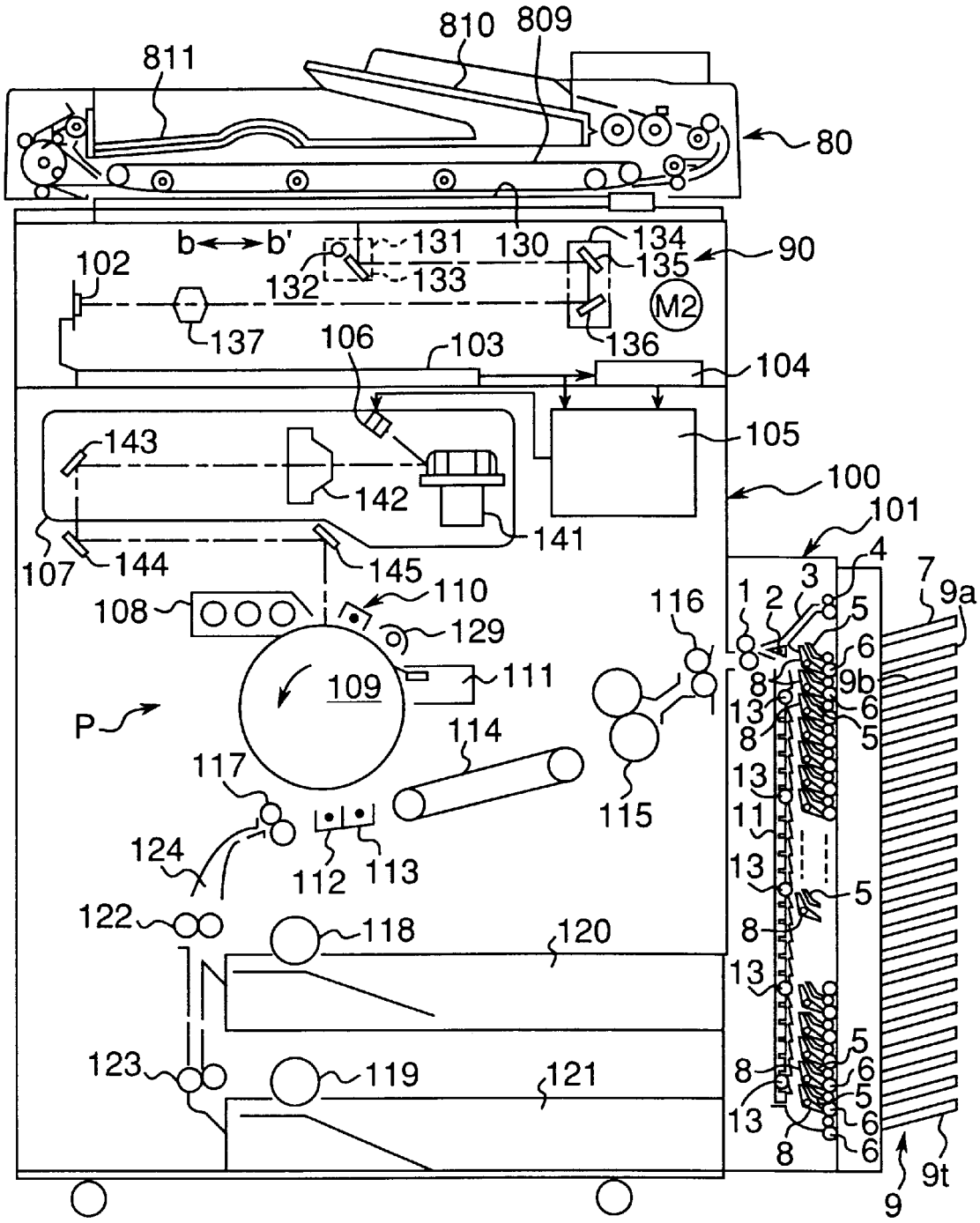
FIG. 1 is a view showing the overall construction of an image forming apparatus according to one embodiment of the present invention.

FIG. 1 is a view showing the overall construction of an image forming apparatus to which the present invention is applied.

This image forming apparatus is the so-called digital copying machine and is provided with a main body 100 including an image reading section 90 and a printer section P, an automatic document feeder 80 mounted on the main body 100 and a sorter 101 provided on a side of the main body 100.

This image forming apparatus also operates as a printer for printing an image upon externally receiving a print job in a mail bin mode in addition to the execution of the original operation as a copying machine. The printer section P and the sorter 101 of the main body 100 operate in the mail bin mode, and the automatic document feeder 80 and the image reading section 90 in addition to the printer section P and the sorter 100 operate in a copying machine mode.

The automatic document feeder 80 automatically conveys an original document set on an original document supply tray 810 onto an original document glass 130 by a conveyance system 809 and discharges the original document read by the image reading section 90 onto an original document discharging section 811.

The image reading section 90 reads the image of the original document placed on the original document glass 130 and generates image data corresponding to the pixels of the image of the original document. In more detail, a scan motor M2 is driven to move a first scanner 131 having an exposure lamp 132 and a first mirror 133 and a second scanner 134 having second and third mirrors 135 and 136 in the direction of arrow b–b' (sub-scanning direction). Light of the exposure lamp 132 is reflected on the original document placed on the original document glass 130 and applied to a line sensor 102 via mirrors 133, 135 and 136 and a lens 137. The line sensor 102 is constructed by arranging a number of photoelectric transducers in a direction (main scanning direction) perpendicular to the direction of the plane of the sheet of FIG. 1 and outputs image data corresponding to each pixel. The image data outputted from the line sensor 102 is processed by an image signal processing section 103 and thereafter transmitted to a memory unit 104. The memory unit 104 transmits the image data received from the image signal processing section 103 to a print processing unit 105 while storing the data into an image memory or directly without the storage.

The print processing unit 105 controls a laser optical system 107 of the printer section P on the basis of the image data received through a communication line (not shown) from the outside of this image forming apparatus or from the memory unit 104. The laser optical system 107 makes a semiconductor laser 106 radiate the laser beam controlled by the print processing unit 105, and the laser beam radiated from the semiconductor laser 106 is used for scanning on a photoreceptor drum 109 via a polygon mirror 141, an fθ-lens 142 and mirrors 143, 144 and 145.

In an approximate center portion of the printer section P is arranged the photoreceptor drum 109 that is rotatively driven. Around the photoreceptor drum 109 are provided an electrostatic charger 110, a developer 108, a transfer charger 112, a separation charger 113, a cleaner 111 and an eraser lamp 129 along the direction of rotation of the drum.

A sheet is supplied from either one of sheet cassettes 120 and 121 by sheet supply rollers 118 and 119 and fed into the position of the transfer charger 112 by vertical conveyance rollers 122 and 123, a sheet conveyance path 124 and a timing roller 117. The sheet on which a toner image is transferred in the position of the transfer charger 112 by the known electrophotographic process is discharged from the printer section P to the sorter 101 via a conveyance belt 114, a fixing unit 115 and a discharge roller 116.

The sorter 101 is provided with a conveyance roller 1 for taking in the sheet discharged from the printer section P of the main body 100, a diverter pawl 2 for vertically switching the conveyance path depending on a non-sort mode (a mode in which sheets are not sorted) and a sort mode (a mode in which sheets are sorted into trays), a non-sort bin 7 arranged in a fixed manner in the uppermost tier and vertically movable sort bins 9*a*, 9*b*, . . . , 9*t* arranged in a plurality of tiers below the non-sort bin 7. The non-sort bin 7 and the sort bins 9*a*, 9*b*, . . . , 9*t* are arranged parallel to one another in an upwardly inclined direction.

In the non-sort mode, the sheet taken in via the conveyance roller 1 is conveyed to an upper conveyance path 3 by the switching operation of the diverter pawl 2 and discharged onto the non-sort bin 7 via a discharge roller 4.

A conveyance path that extends downward from the diverter pawl 2 is constructed roughly of a perpendicular guide member 11 that extends perpendicularly downward from the proximity of the diverter pawl 2, a plurality of guide members 5, 5, . . . , 5 that are arranged along the perpendicular guide member 11 and bent toward the sort bins 9*a*, 9*b*, . . . , 9*t*, respectively and a plurality of diverter pawis 8, 8, . . . , 8 provided between the perpendicular guide member 11 and the respective guide members 5. Five conveyance rollers 13 for conveying the sheet downward are arranged at regular intervals along the perpendicular guide member 11. Outlets defined by the guide members 5 and the corresponding diverter pawls 8 are each provided with a discharge roller 6.

In a sort mode, the sheet taken in via the conveyance roller 1 is guided to the lower conveyance path by the switching operation of the diverter pawl 2 and conveyed downward by the conveyance rollers 13. The sheet conveyed downward has its path switched by one of the plurality of diverter pawls 8 so as to be guided to a space between the diverter pawl 8 and the corresponding guide member 5. Then, the sheet is discharged onto the corresponding sort bin via the corresponding discharge roller 6.

Figure 2:
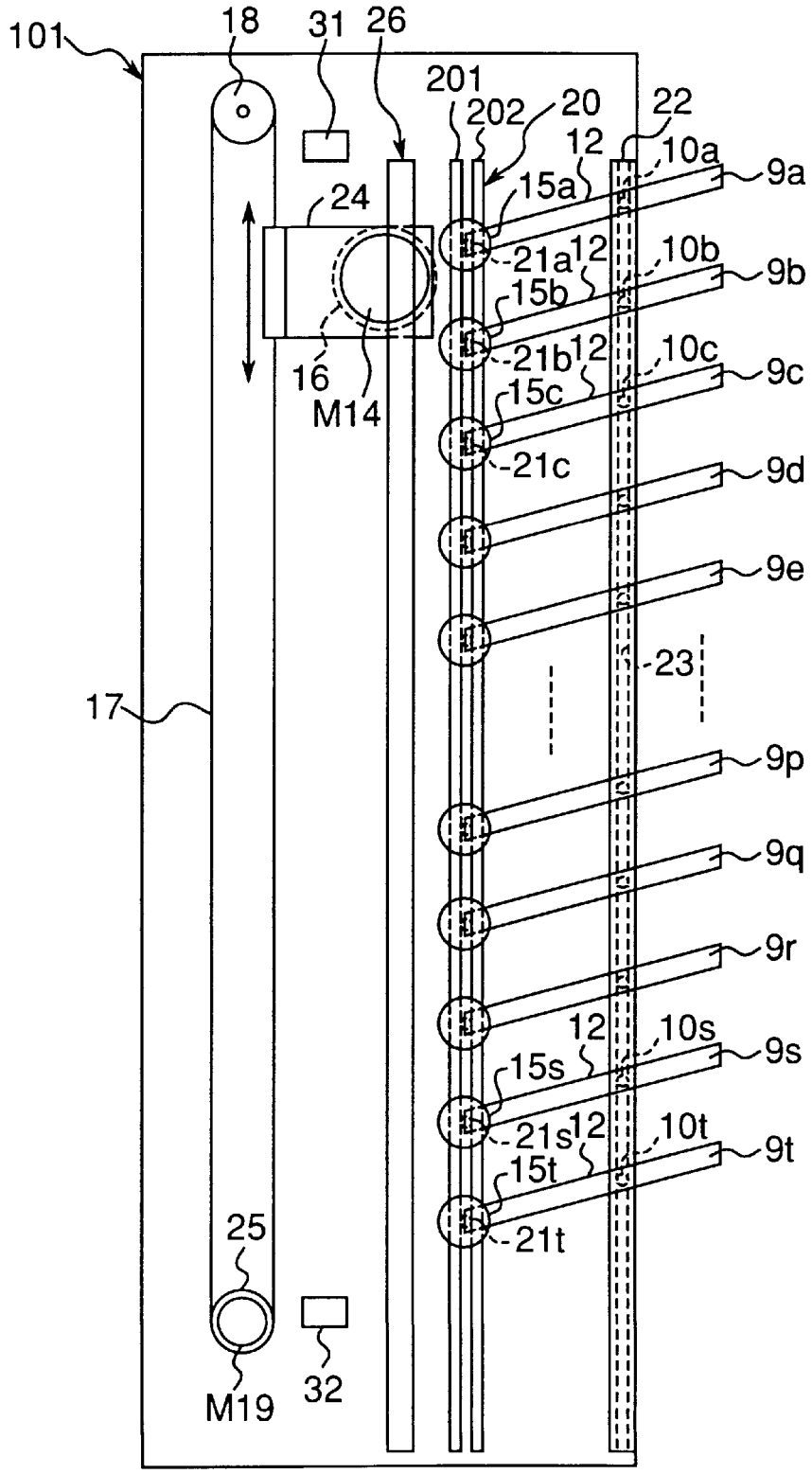
FIG. 2 is a view schematically showing the essential part of the sorter of the above image forming apparatus viewed from a side.
Figure 4:
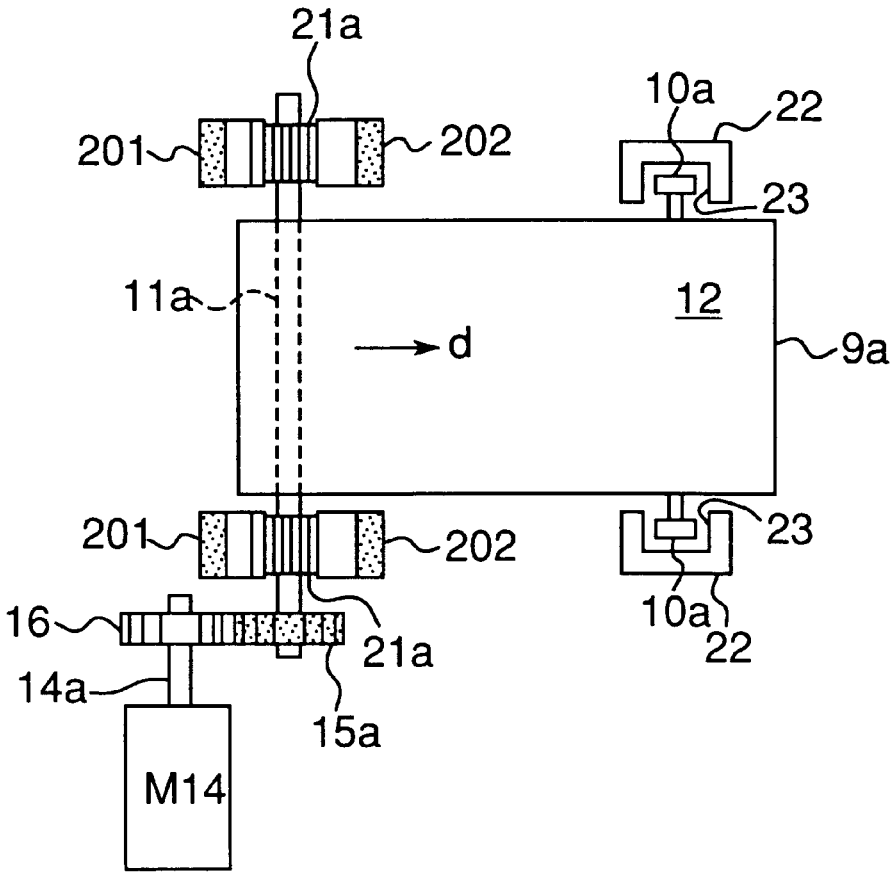
FIG. 4 is a view showing the bin tray of FIG. 2 and its periphery viewed from above.

FIG. 2 is an enlarged side view showing the sort bins (referred to as bin trays hereinafter) 9*a*, 9*b*, . . . , 9*t* inside the sorter 101, while FIG. 4 is a top view of the bin tray 9*a*. As illustrated in these figures, each of the bin trays 9*a*, 9*b*, . . . , 9*t* has a roughly rectangular plate-shaped tray body 12. As clearly illustrated in FIG. 4 showing the bin tray 9*a* viewed from above, a pair of ear-like portions 10*a* and 10*b* that protrude horizontally outwardly are provided symmetrically at the side edges of the front part (indicating a part located on the downstream side of the center of the tray body in regard to a sheet discharge direction d) of the tray body 12. On the other hand, at the base part (indicating a part located on the upstream side of the center of the tray body in regard to the sheet discharge direction d) of the tray body 12 is rotatably provided a transverse shaft 11*a* that extends horizontally perpendicularly to the sheet discharge direction d. In the vicinity of the ends that belong to the transverse shaft 11a and are located apart from the side edges of the tray body 12 is mounted a pair of pinion gears 21*a* and 21*a* coaxially and integrally with the transverse shaft 11*a*. One end of the transverse shaft 11*a* is mounted with a spur gear 15*a* coaxially and integrally with the transverse shaft 11*a*. As described later, this spur gear 15*a* can mesh with a spur gear 16 mounted coaxially and integrally with an output shaft 14*a* of a motor M14. The other bin trays 9*b*, . . . , 9*t* arranged parallel below the bin tray 9*a* each similarly have a pair of ear-like portions 10*b*, . . . , 10*t*, transverse shafts 11*b*, . . . , 11*t*, a pair of pinion gears 21*b*, . . . , 21*t* and spur gears 15*b*, . . . , 15*t*.

Inside the sorter 101 is provided a mechanism 20 that retains the bin trays 9*a*, 9*b*, . . . , 9*t* and vertically moves parallel the bin trays 9*a*, 9*b*, . . . , 9*t* so as to individually change the capacities of the bin trays 9*a*, 9*b*, . . . , 9*t*.

Figure 3:
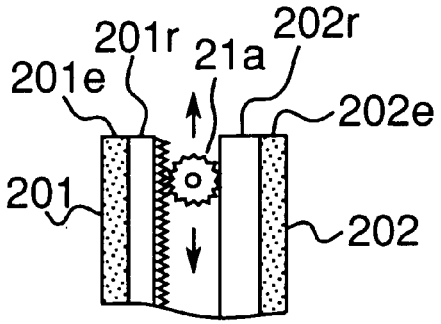
FIG. 3 is a view showing a pinion gear provided for a transverse shaft at the base part of one bin tray as well as a rack member and a slide contact guide member which hold the pinion gear between them.

That is, inside the sorter 101 is fixed a pair of guide rails 22 and 22 that have a bracket-figured section shape and extend in the perpendicular direction with the ear-like portions 10*a*, 10*b*, . . . , 10*t* lodged therein in a position opposite to the side edges of the front parts of the bin trays 9*a*, 9*b*, . . . , 9*t*. On the other hand, on both sides of the base parts of the bin trays 9*a*, 9*b*, . . . , 9*t* is provided a pair of rack members 201 and 201 that extend perpendicularly and mesh with the pinion gears 21*a*, 21*b*, . . . , 21*t*. On the opposite side of the rack members 201 with respect to the pinion gears 21*a*, 21*b*, . . . , 21*t* is provided a slide guide member 202 that extends in the perpendicular direction. As shown in FIG. 3, the rack member 201 is constructed of a rigid portion 201*r* formed with a rack to be meshed with the pinion gears 21*a*, 21*b*, . . . , 21*t* and an elastic portion 201*e* arranged outwardly along this rigid portion 201*r*. The slide guide member 202 is constructed of a rigid portion 202r having a flat surface to be brought in sliding contact with the pinion gears 21*a*, 21*b*, . . . , 21*t* and an elastic portion 202*e* arranged outwardly along this rigid portion 202*r*. The rack member 201 and the slide guide member 202 are held between a retaining member (not shown) arranged along the exteriors of the elastic portions 201*e* and 202*e*, respectively. Consequently, the pinion gears 21*a*, 21*b*, . . . , 21*t* are pressed against the rack member 201 by the elasticity owned by the elastic portions 201*e* and 202*e* so as to be meshed with the rack member 201 without backlash.

As a result of the meshing engagement of the pinion gears 21*a*, 21*b*, . . . , 21*t* with the rack member 201 without backlash under pressure, the base parts of the bin trays 9*a*, 9*b*, . . . , 9*t* can maintain respective specified height levels together with the transverse shafts 11*a*, 11*b*, . . . , 11*t* against the gravitation. The front part of each of the bin trays 9*a*, 9*b*, . . . , 9*t* tries to rotate clockwise in FIG. 2 due to its own gravitation, whereas the ear-like portions 10*a*, 10*b*, . . . , 10*t* are engaged with the inner surface 23 of the guide rail 22 by abutting against the surface. As described above, the bin trays 9*a*, 9*b*, 9*t* are retained in the specified positions. It is to be noted that the tilt angle of the tray body 12 relative to the horizontal plane is roughly determined by a ratio of a distance dimension in the lengthwise direction of the tray body 12 between the transverse shafts 11*a*, 11*b*, . . . , 11*t* and the ear-like portions 10*a*, 10*b*, . . . , 10*t* to a distance dimension in the horizontal direction between the rack member 201 (or the slide guide member 202) and the guide rail 22.

Furthermore, as shown in FIG. 2, a guide rail 26 that extends in the perpendicular direction is provided for guiding the motor M14 mounted on a motor holder 24 along the rack member 201. A sprocket 18 is mounted at a level higher than a range in which the bin tray 9*a* can move inside the sorter 101. On the other hand, a motor M19 for rotatively driving a sprocket 25 is mounted at a level lower than a range in which the bin tray 9*t* can move. Then, a chain 17 wound around these sprockets 18 and 25 is provided, and both ends of the chain 17 are connected to the motor holder 24. Therefore, by rotatively driving the motor M19, the motor M14 can be moved upward or downward together with the motor holder 24 along a guide rail 26. Near the sprockets 18 and 25 are provided sensors 31 and 32 for detecting whether or not the motor M14 is located in the uppermost position or the lowermost position, respectively.

As already described above, the spur gear 16 is mounted coaxially and integrally with the output shaft of the motor M14. The motor M14 moves upward or downward by rotatively driving the motor M19, and when the motor M14 comes to a height at the same level as that of a specified bin tray of, for example, (the base part of) the bin tray 9*a*, the spur gear 16 meshes with the spur gear 15*a* mounted on the transverse shaft 11*a* of the bin tray 9*a*. Therefore, by rotating the spur gear 16 with the rotative driving of the motor M14, the transverse shaft 11*a* and the pinion gear 21*a* can be rotated via the spur gear 15*a*. By the meshing engagement of this rotating pinion gear 21*a* with the rack member 201, the base part of the bin tray 9*a* moves upward or downward together with the transverse shaft 11*a*. At the same time, the ear-like portion 10*a* slides upward or downward along the inner surface 23 of the guide rail 22 so as to keep the tilt angle of the tray body 12 relative to the horizontal plane. Therefore, the front part of the bin tray 9*a* moves upward or downward along the guide rail 22. As described above, the bin tray 9*a* can be moved parallel upward or downward.

The other bin trays 9*b*, . . . , 9*t* arranged below the bin tray 9*a* can be similarly moved parallel upward or downward by the upward or downward movement of the motor M14 with the rotative driving of the motor M19 and the rotation of the pinion gears 21*b*, . . . , 21*t* with the rotative driving of the motor M14.

If it is desired to move the bin tray 9*a* in the first tire and thereafter make the motor M14 pass by the bin tray 9*b* in the second tire in order to move the bin tray 9*c* in the third tire, then the excitation of the motor M14 is stopped during the passing. With this arrangement, the output shaft 14*a* of the motor M14 and the spur gear 16 are put into a free state, thereby allowing the motor to pass by the bin tray 9*b* without rotating the spur gear 15*b*.

Figure 5:
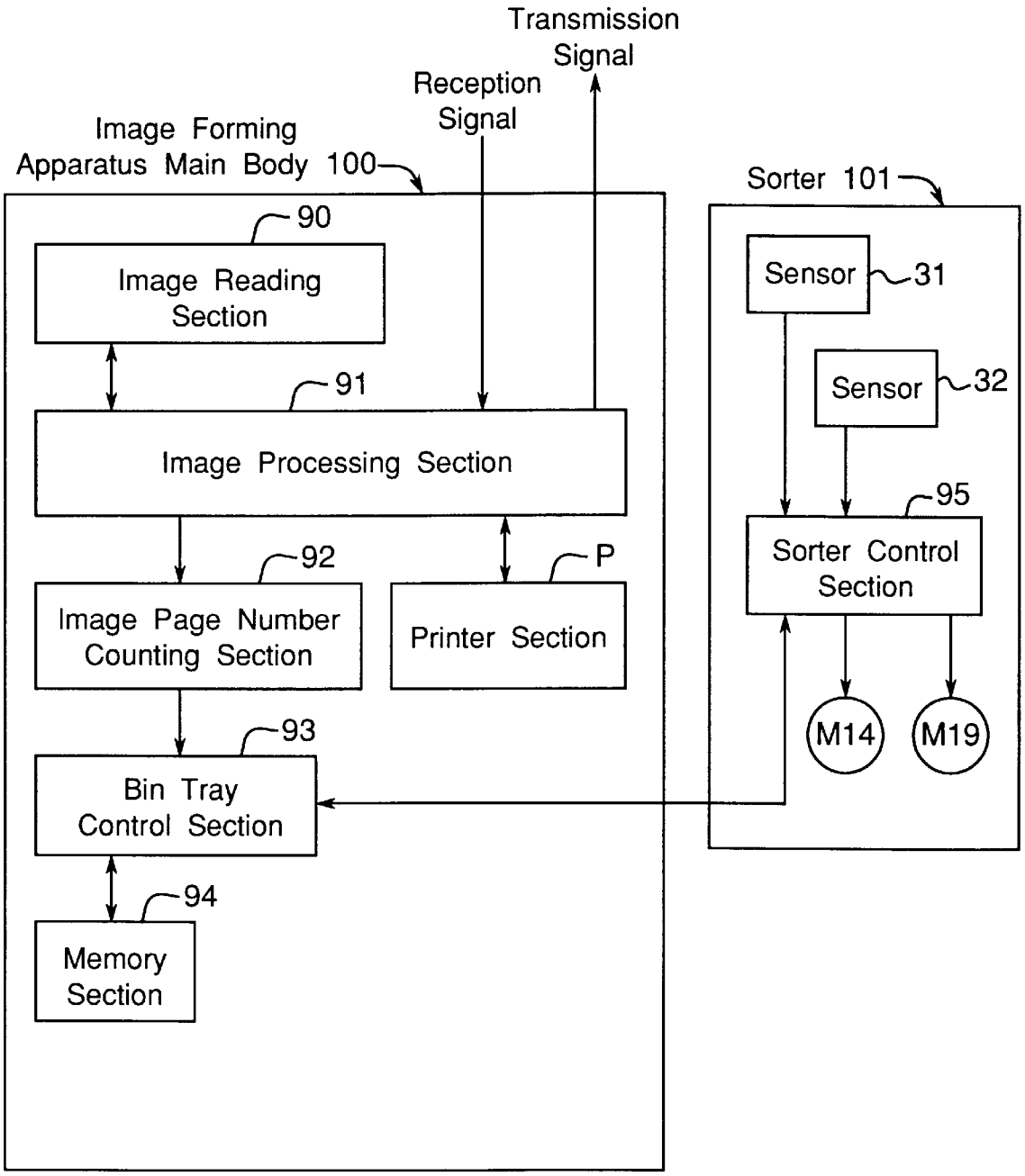
FIG. 5 is a block diagram showing the control system of the above image forming apparatus.

FIG. 5 shows a block construction of the control system of this image forming apparatus. The main body 100 is provided with an image processing section 91, an image page number counting section 92, a bin tray control section 93 and a memory section 94. The image processing section 91 controls the printer section P on the basis of a print job received from the image reading section 90 or a print job externally received through a communication line (not shown). The image page number counting section 92 counts the number of pages to be printed (referred to as a "received number of pages" hereinafter) received by the image processing section 91. The bin tray control section 93 controls the sorter 101 on the basis of the received number of pages counted by the image page number counting section 92 as described later. The memory section 94 temporarily stores therein data to be used for the processing by the bin tray control section 93. Inside the sorter 101 is provided a sorter control section 95 for rotatively driving the motors M14 and M19 on the basis of a control signal from the bin tray control section 93.

The control of the image forming apparatus in the sort mode, i.e., particularly the control in the mail bin mode in which an image is printed by the printer section P on the basis of the print job transmitted externally and the printed sheet is discharged onto any one of the bin trays 9*a*, 9*b*, . . . , 9*t* of the sorter 101, which is designated as the destination of discharge (destination) of this print job, will be described with reference to the flow of FIGS. 6A and 6B.

It is to be noted that the bin trays 9*a*, 9*b*, . . . , 9*t* are arranged at regular intervals in the perpendicular direction in the initial state and the sheet accommodating capacity of each of the bin trays 9*a*, 9*b*, . . . , 9*t* corresponds to 50 sheets.

(1) First, a print job is received in the image processing section 91 (S1). Then, the bin tray control section 93 designates the bin tray onto which the printed sheet is to be discharged (referred to as a "designated bin tray" hereinafter) among the plurality of bin trays 9*a*, 9*b*, . . . , 9*t* on the basis of the designated destination of the received print job (S2). It is assumed that the bin tray 9*b* is the designated bin tray in this example. By appropriately switching the diverter pawl 2 and the diverter pawls 8 shown in FIG. 1 according to this designation of the bin tray, a conveyance path for conveying the sheet that is taken in via the conveyance roller 1 to the designated bin tray is secured.

(2) Next, the image page number counting section 92 counts the received number of pages, and the bin tray control section 93 decides whether or not the received number of pages is greater than the specified number, or the initial sheet accommodating capacity of each bin tray of 50 sheets in this case (S3). When the received number of pages is not greater than 50, meaning that there is no need for increasing the capacity of the designated bin tray, the program flow proceeds immediately to step S10.

(3) When the received number of pages is greater than 50, the sorter control section 95 decides whether or not the motor M14 is located in the upper limit position or the lower limit position via an upper limit sensor 31 or a lower limit sensor 32 (S4). When the motor M14 is not located in the upper limit position or the lower limit position, the sorter control section 95 rotatively drives the motor M19 to move the motor M14 to the upper limit position or the lower limit position (S5). Whether the motor M14 has reached the upper limit position or the lower limit position is confirmed by the upper limit sensor 31 or the lower limit sensor 32 (S6). In this example, the motor M14 is moved to the upper limit position closer to the designated bin tray 9*b* in terms of improving the positional accuracy.

(4) Next, the motor M19 is rotatively driven to move the motor M14 from the upper limit position or the lower limit position to the height of the base part of the designated bin tray (S7, S8). In this example, the motor M14 is moved from the upper limit position to the height of the base part of the bin tray 9*b* (see FIG. 2). In this stage, the spur gear 16 mounted on the output shaft of the motor M14 meshes with the spur gear 15*b* mounted on the transverse shaft 11*b* of the designated bin tray 9*b*.

(5) Next, the motor M14 is rotatively driven to move parallel downward the designated bin tray, thereby changing the capacity of the designated bin tray from 50 sheets to, for example, 100 sheets (S9). In this case, the height of the designated bin tray 9*b* changes when the motor M14 is rotated, and therefore, the motor M19 as well as the motor M14 are rotatively driven to make the height of the motor M14 follow the height of the base part of the designated bin tray 9*b* during this movement process. Specifically, the motor M19 is rotated by n steps so as to eliminate the difference in reduction ratio between the motors M14 and M19 every time the motor M14 is rotated by one step.

(6) Subsequently, the received image is printed on a sheet in the printer section P, and the one printed sheet is discharged onto the designated bin tray 9*b* via the preliminarily secured conveyance path and the discharge roller 6 (see FIG. 1) corresponding to the height of the designated bin tray 9*b* (S10). The bin tray control section 93 confirms the discharge of the sheet onto the designated bin tray by means of a sheet detection sensor (not shown) provided on the designated bin tray, thereby counting the number of discharged sheets (incrementing the counter by one (+1)) (S11).

(7) Next, the bin tray control section 93 decides whether or not the number of discharged sheets on the designated bin tray 9*b* has reached the specified number (50) (S12). When the number of discharged sheets has not reached the number of 50, the program flow proceeds to step S14 to decide whether or not the print job is completed (S14). When the print job is not completed, the program flow returns to step S10 to discharge one printed sheet onto the designated bin tray 9*b* (S10), and the processes in steps S11, S12 and S14 will be repeated. If the number of discharged sheets on the designated bin tray 9*b* reaches the specified number (50) in the course of this process, then the discharge roller 6 for use is changed to the one in the upwardly adjacent tire so as to reduce the variation of the difference in height accompanying the sheet discharge, thereby smoothly performing the sheet discharge (S13). Then, the processes of steps S10 through S14 will be repeated until the print job will be completed.

With this arrangement, the printed sheet is surely discharged onto the designated bin tray corresponding to the destination, and this avoids leaving the printed sheet behind. This also obviates the need for checking the bin trays other than the designated bin tray.

Figure 7:
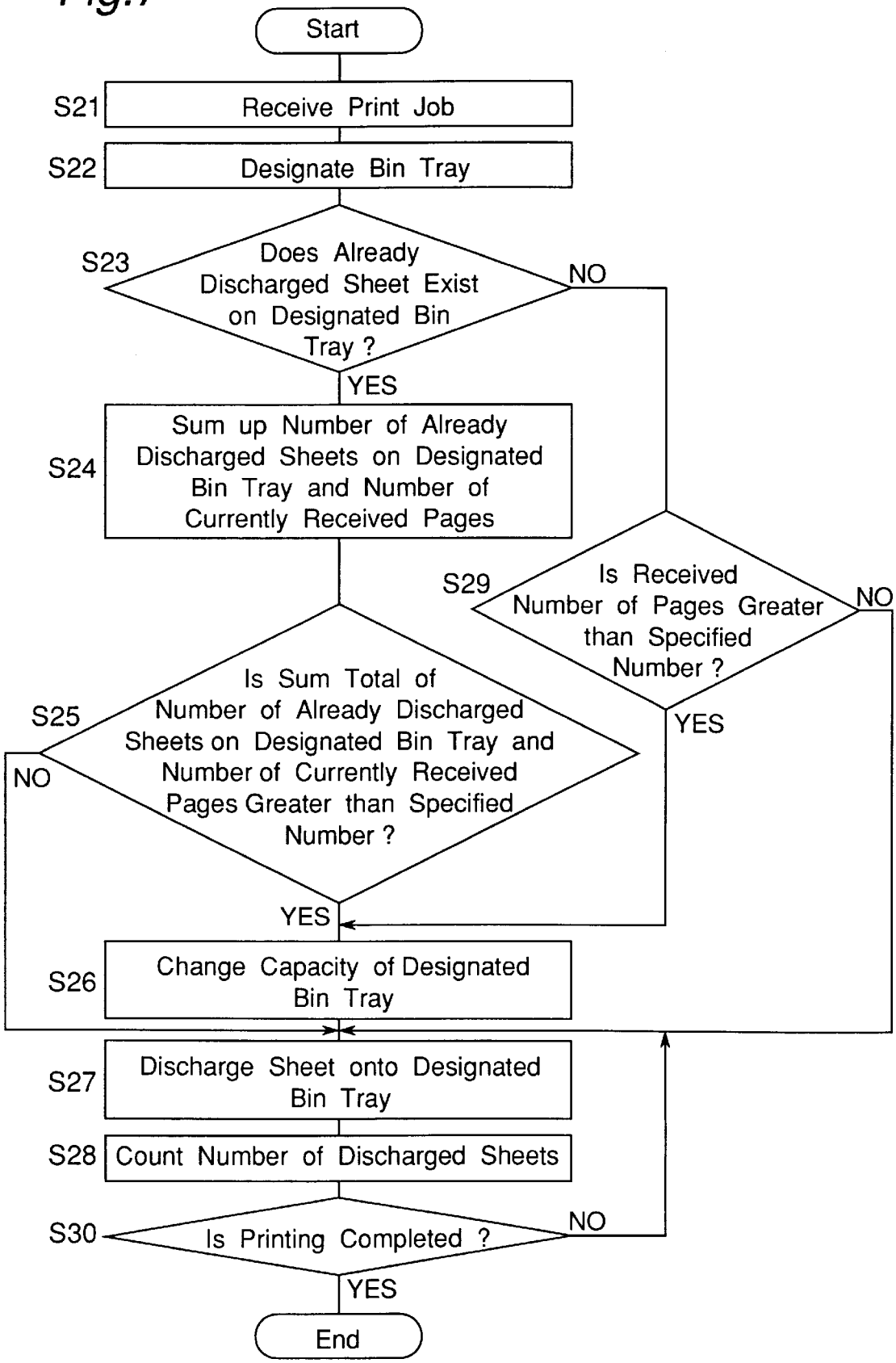
FIG. 7 is a chart showing an operation flow of the above image forming apparatus.

Next, control in the case where a sheet that has already been discharged on the designated bin tray (referred to as an "already discharged sheet") exists at the time of the current reception in the mail bin mode will be described with reference to the flow shown in FIG. 7.

In this example, it is assumed that the number of the already discharged sheets on each of the bin trays 9*a*, 9*b*, . . . , 9*t* are stored in the memory section 94 shown in FIG. 5.

(1) First, a print job is received in the image processing section 91 (S21). Then, the bin tray control section 93 designates the bin tray onto which the printed sheet is to be discharged on the basis of the destination designated by the received print job (S22). In this example, it is assumed that the bin tray 9*b* is the designated bin tray. By appropriately switching the diverter pawl 2 and the diverter pawls 8 shown in FIG. 1 according to this designation of the bin tray, a conveyance path for conveying the sheet that is taken in via the conveyance roller 1 to the designated bin tray is secured.

(2) Next, the bin tray control section 93 decides the presence or absence of the already discharged sheet on the designated bin tray 9*b* by means of the sheet detection sensor (not shown) provided on the designated bin tray 9*b* (S23). In the case where the already discharged sheet exists on the designated bin tray 9*b*, the number of the already discharged sheets on the designated bin tray 9*b* is read referring to the memory section 94. Then, the number of the already discharged sheets on the designated bin tray 9*b* and the number of the currently received pages are summed up (S24), and it is decided whether or not the sum total is greater than the specified number, or the initial capacity of 50 sheets in this example (S25). In the case where no already discharged sheet exists on the designated bin tray 9*b*, it is further decided whether or not the number of the currently received pages is greater than the specified number, or the initial sheet accommodting capacity of each bin tray of 50 sheets (S29). In the case where no already discharged sheet exists on the designated bin tray 9*b* and the number of the currently received pages is not greater than the initial capacity of 50 sheets, meaning that there is no need for increasing the capacity of the designated bin tray, the program flow proceeds to step S27 as described later.

Figure 6A:
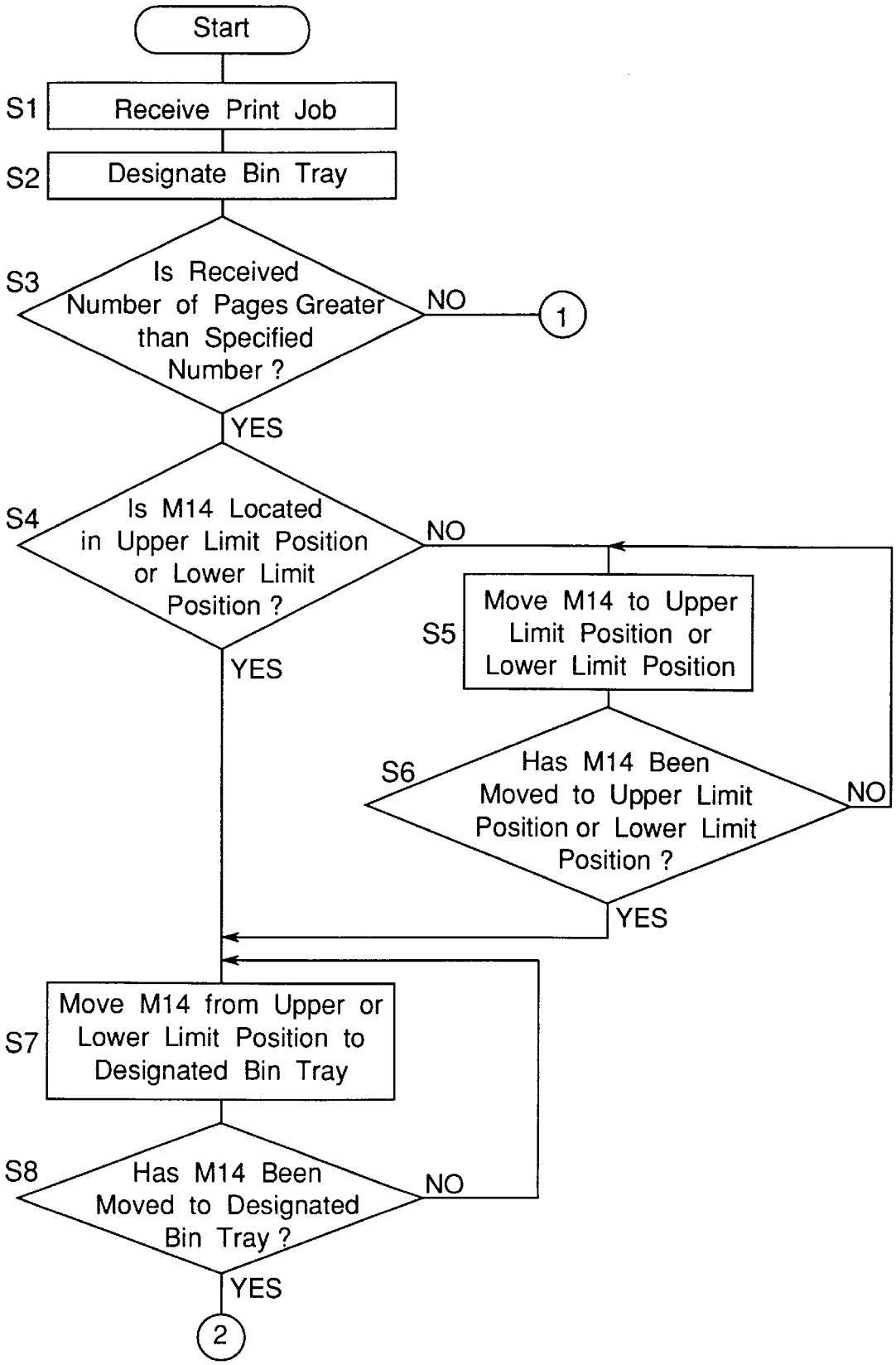
FIGS. 6A and 6B are a chart showing an operation flow of the above image forming apparatus.
Figure 6B:
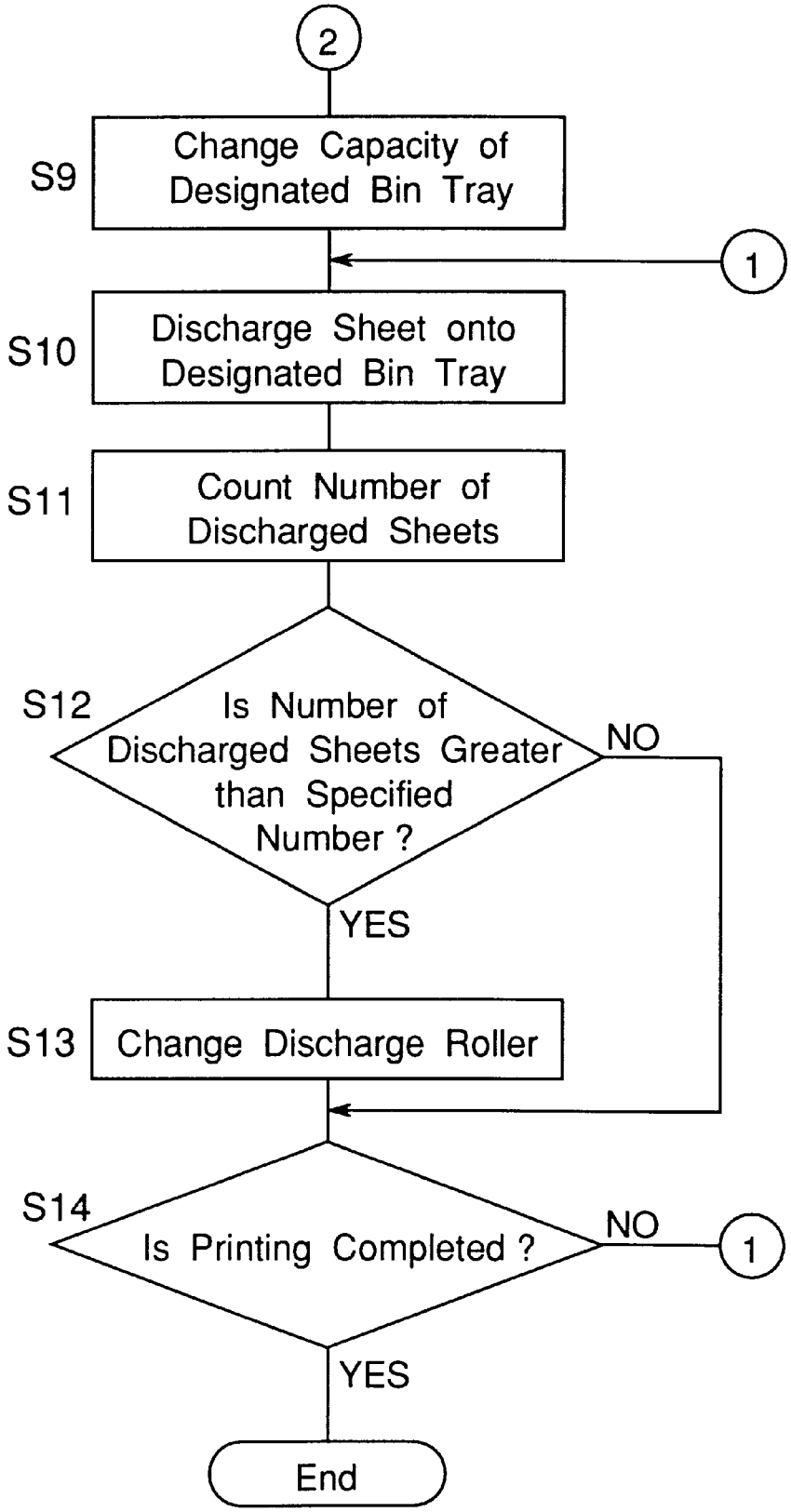

(3) In the case where the sum total of the number of already discharged sheets on the designated bin tray 9*b* and the number of the currently received pages is greater than 50 (YES in S25), or in the case where the number of the currently received pages is greater than the initial capacity of 50 sheets although no already discharged sheet exists on the designated bin tray 9*b* (YES in S29), then the motor M14 is rotatively driven according to a procedure similar to that described with reference to FIGS. 6A and 6B to move the designated bin tray 9*b* parallel downward, thereby changing the capacity of the designated bin tray 9*b* from 50 sheets to, for example, 100 sheets (S26).

(4) Subsequently, the received image is printed on a sheet in the printer section P, and one printed sheet is discharged onto the designated bin tray 9*b* via the preliminarily secured conveyance path and the discharge roller 6 (see FIG. 1) corresponding to the height of the designated bin tray 9*b* (S27). The bin tray control section 93 confirms the discharge of the sheet onto the designated bin tray by means of the sheet detection sensor (not shown) provided on the designated bin tray, thereby counting the number of discharged sheets (incrementing the counter by one (+1)) (S28). Then, the processes of steps S27 and S28 will be repeated until the print job will be completed (S30).

With this arrangement, the printed sheet is surely discharged onto the designated bin tray even though the already discharged sheet exists on the designated bin tray at the time of the reception of the current print job.

Figure 8:
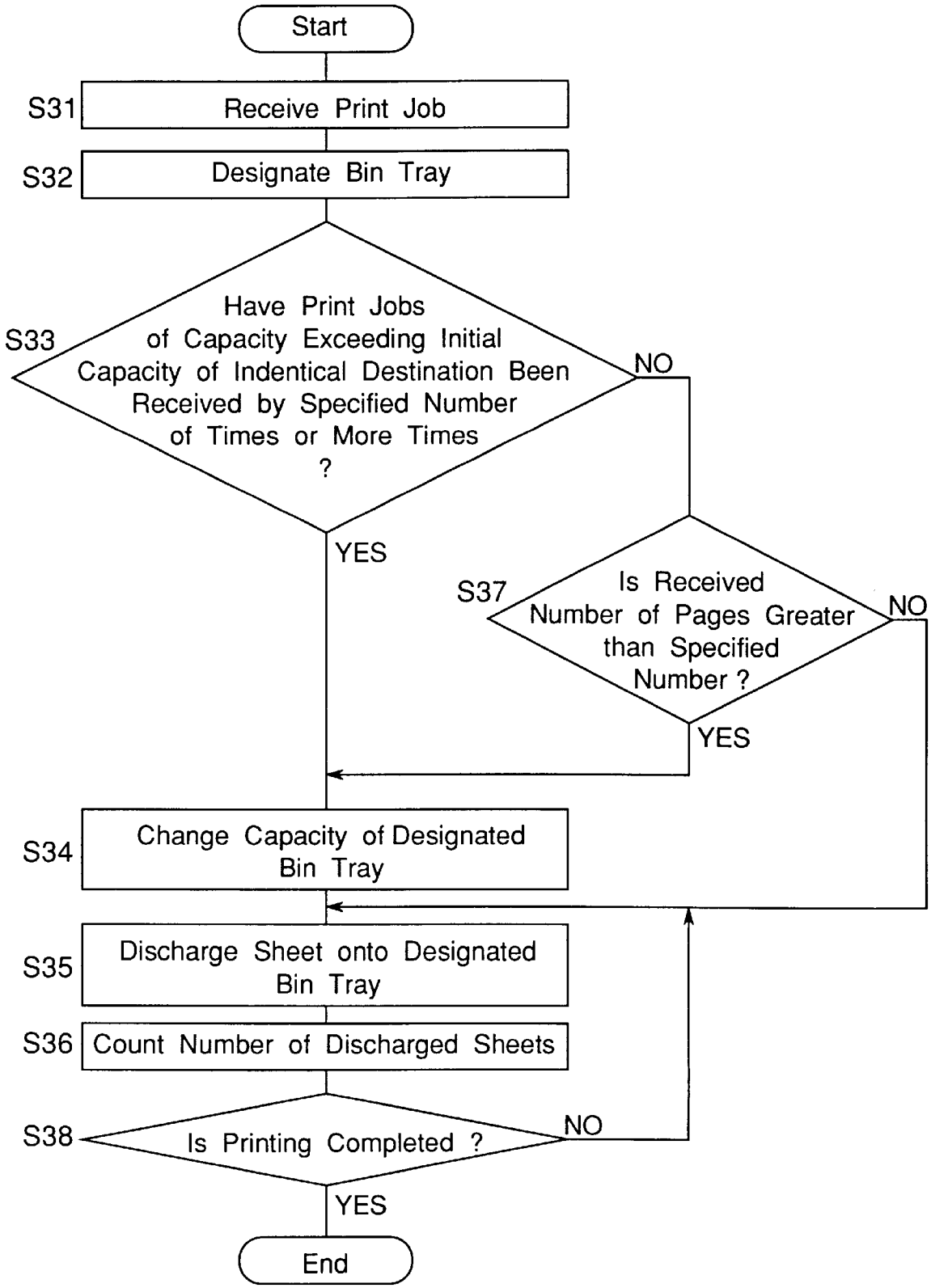
FIG. 8 is a chart showing an operation flow of the above image forming apparatus.

Next, control in the case where a print job of a capacity exceeding the initial sheet accommodating capacity of each bin tray is frequently transmitted designating a specified bin tray in the mail bin mode will be described with reference to the flow shown in FIG. 8.

In this example, it is assumed that the number of times of the transmission of print jobs of a capacity exceeding the initial capacity of 50 sheets with regard to each of the bin trays 9*a*, 9*b*, . . . , 9*t* are stored in the memory section 94 shown in FIG. 5.

(1) First, a print job is received in the image processing section 91 (S31). Then, the bin tray control section 93 designates the bin tray onto which the printed sheet is to be discharged on the basis of the destination designated by the received print job (S32). In this example, it is assumed that the bin tray 9*b* is the designated bin tray. By appropriately switching the diverter pawl 2 and the diverter pawls 8 shown in FIG. 1 according to this designation of the bin tray, a conveyance path for conveying the sheet that is taken in via the conveyance roller 1 to the designated bin tray is secured.

(2) Next, the bin tray control section 93 reads the number of times of the transmission of print jobs of a capacity exceeding the initial capacity of 50 sheets designating the designated bin tray 9*b* referring to the memory section 94. Then, it is decided whether or not the number of times is greater than a specified number of times (preliminarily inputted by the user), or, for example, 10 times (S33). In the case where the number of times of the transmission of print jobs of a capacity exceeding the initial capacity of 50 sheets designating the designated bin tray 9*b* is not greater than 10 times, it is further decided whether or not the number of the currently received pages is greater than the specified number, or the initial sheet accommodating capacity of each bin tray of 50 sheets (S37). In the case where the number of times of the transmission of print jobs of a capacity exceeding the initial capacity of 50 sheets designating the designated bin tray 9*b* is not greater than 10 times and the number of the currently received pages is not greater than the initial capacity of 50 sheets, meaning that there is no need for increasing the capacity of the designated bin tray, the program flow proceeds to step S35 as described later.

(3) In the case where the number of times of the transmission of print jobs of a capacity exceeding the initial capacity of 50 sheets designating the designated bin tray 9*b* is greater than 10 times or the number of the currently received pages is greater than the initial capacity of 50 sheets, then the motor M14 is rotatively driven according to a procedure similar to that described with reference to FIG. 6 to move the designated bin tray 9*b* parallel downward, thereby changing the capacity of the designated bin tray 9*b* from 50 sheets to, for example, 100sheets (S34).

(4) Subsequently, the received image is printed on a sheet in the printer section P, and one printed sheet is discharged onto the designated bin tray 9*b* via the preliminarily secured conveyance path and the discharge roller 6 (see FIG. 1) corresponding to the height of the designated bin tray 9*b* (S35). The bin tray control section 93 confirms the discharge of the sheet onto the designated bin tray by means of the sheet detection sensor (not shown) provided on the designated bin tray, thereby counting the number of discharged sheets (incrementing the counter by one (+1)) (S36). Then, the processes of steps S35 and S36 will be repeated until the print job will be completed (S38).

With this arrangement, in the case where print jobs of a capacity exceeding the initial capacity are frequently transmitted designating the specified bin tray, the capacity of the specified bin tray can be preparatorily increased prior to the reception. Therefore, this arrangement obviates the need for changing the capacity of the designated bin tray every time the print job is received, so that a time from the start of printing to the time of print discharge can be reduced.

The flows of FIGS. 6A and 6B, FIG. 7 and FIG. 8 may, of course, be implemented in combination.

Although the above embodiments have been described taking the case where the present invention is applied to the digital copying machine that can be used as a printer as an example, the present invention can, of course, be applied to the normal printers and other image forming apparatuses. Furthermore, the digital copying machine of the above embodiments is the one that forms an image by the electrophotographic process, however, the image forming system of the image forming apparatus to which the present invention is applied may be any type.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

a printer section for printing an image on a sheet;

a sorter having a plurality of bins onto which a sheet printed with the image by the printer section is discharged;

a receiving section for receiving a print job transmitted externally, the print job including information indicating the number of pages of the image to be printed and the bin onto which the sheet printed with the image is to be discharged; and a controller for increasing a sheet accommodating capacity of said bin onto which the sheet is to be discharged when the number of pages of the print job received by said receiving section is greater than a specified number.

2. An image forming apparatus as claimed in claim 1, wherein said specified number is an initial sheet accommodating capacity of the bin onto which said sheet is to be discharged.

3. An image forming apparatus as claimed in claim 1, wherein the plurality of bins of said sorter are arranged at equal intervals in a direction approximately perpendicular to a plane in which the sheet is placed, and said controller increases the sheet accommodating capacity of said bin onto which the sheet is to be discharged by moving said bin in said direction.

4. An image forming apparatus comprising:

a printer section for printing an image on a sheet;

a sorter having a plurality of bins onto which a sheet printed with the image by the printer section is discharged;

a receiving section for receiving a print job transmitted externally, the print job including information indicating the number of pages of the image to be printed and the bin onto which the sheet printed with the image is to be discharged; and a controller for increasing a sheet accommodating capacity of said bin onto which the sheet is to be discharged when a sum total of the number of sheets that have already been discharged on said bin and the number of pages of the print job is greater than a specified number.

5. An image forming apparatus as claimed in claim 4, wherein said specified number is an initial sheet accommodating capacity of said bin onto which the sheet is to be discharged.

6. An image forming apparatus as claimed in claim 4, wherein said controller further decides whether the number of pages of the print job is greater than said specified number when no sheets have yet been discharged on said bin onto which the sheet is to be discharged, and increases the sheet accommodating capacity of said bin onto which the sheet is to be discharged when the number of pages of the print job is greater than said specified number.

7. An image forming apparatus as claimed in claim 4, wherein the plurality of bins of said sorter are arranged at equal intervals in a direction approximately perpendicular to a plane in which the sheet is placed, and said controller increases the sheet accommodating capacity of said bin onto which the sheet is to be discharged by moving said bin in said direction.

8. An image forming apparatus comprising:

a printer section for printing an image on a sheet;

a sorter having a plurality of bins onto which a sheet printed with the image by the printer section is discharged;

a receiving section for receiving a print job transmitted externally, the print job including information indicating the number of pages of the image to be printed and the bin onto which the sheet printed with the image is to be discharged; and a controller for increasing a sheet accommodating capacity of said bin onto which the sheet is to be discharged when the number of times of reception of a print job having pages exceeding in number a specified number of pages is greater than a specified number of times in regard to said bin onto which the sheet is to be discharged.

9. An image forming apparatus as claimed in claim 8, wherein said specified number of pages is an initial sheet accommodating capacity of said bin onto which the sheet is to be discharged.

10. An image forming apparatus as claimed in claim 8, wherein said controller further decides whether the number of pages of the print job received by said receiving section is greater than said specified number of pages when the number of times of reception of the print job having pages exceeding in number said specified number of pages is not greater than said specified number of times, and increases the sheet accommodating capacity of said bin onto which the sheet is to be discharged when the number of pages of the print job is greater than said specified number of pages.

11. An image forming apparatus as claimed in claim 8, wherein the plurality of bins of said sorter are arranged at equal intervals in a direction approximately perpendicular to a plane in which the sheet is placed, and said controller increases the sheet accommodating capacity of said bin onto which the sheet is to be discharged by moving said bin in said direction.

12. A method for controlling a sorter that is connected to an image forming apparatus and has a plurality of bins onto which a sheet printed with an image by the image forming apparatus is discharged, comprising the steps of:

receiving an externally transmitted print job, the print job including information indicating the number of pages of the image to be printed and the bin onto which the sheet printed with the image is to be discharged; and increasing a sheet accommodating capacity of said bin onto which the sheet is to be discharged when the number of pages of the received print job is greater than a specified number.

13. A method as claimed in claim 12, wherein said specified number is an initial sheet accommodating capacity of said bin onto which the sheet is to be discharged.

14. A method for controlling a sorter that is connected to an image forming apparatus and has a plurality of bins onto which a sheet printed with an image by the image forming apparatus is discharged, comprising the steps of:

receiving an externally transmitted print job, the print job including information indicating the number of pages of the image to be printed and the bin onto which the sheet printed with the image is to be discharged; and increasing a sheet accommodating capacity of said bin onto which the sheet is to be discharged when a sum total of the number of sheets that have already been discharged on said bin and the number of pages of the print job is greater than a specified number.

15. A method as claimed in claim 14, wherein said specified number is an initial sheet accommodating capacity of said bin onto which the sheet is to be discharged.

16. A method as claimed in claim 14, further comprising the steps of: deciding whether the number of pages of the print job is greater than the specified number when no sheets have yet been discharged on said bin onto which the sheet is to be discharged at said step of increasing; and increasing the sheet accommodating capacity of said bin onto which the sheet is to be discharged when the number of pages of the print job is greater than the specified number at said step of deciding.

17. A method for controlling a sorter that is connected to an image forming apparatus and has a plurality of bins onto which a sheet printed with an image by the image forming apparatus is discharged, comprising the steps of:

receiving an externally transmitted print job, the print job including information indicating the number of pages of the image to be printed and the bin onto which the sheet printed with the image is to be discharged; and increasing a sheet accommodating capacity of said bin onto which the sheet is to be discharged when the number of times of reception of a print job having pages exceeding in number a specified number of pages is greater than a specified number of times in regard to said bin onto which the sheet is to be discharged.

18. A method as claimed in claim 17, wherein said specified number of pages is an initial sheet accommodating capacity of said bin onto which the sheet is to be discharged.

19. A method as claimed in claim 17, further comprising the steps of: deciding whether the number of pages of the received print job is greater than said specified number of pages when the number of times of reception of the print job having pages exceeding in number said specified number of pages is not greater than said specified number of times at said step of increasing; and increasing the sheet accommodating capacity of said bin onto which the sheet is to be discharged when the number of pages of the print job is greater than said specified number of pages.

* * * * *